US006350491B1

(12) United States Patent
Williams

(10) Patent No.: US 6,350,491 B1
(45) Date of Patent: Feb. 26, 2002

(54) PAINTING APPARATUS AND METHOD

(75) Inventor: Terry L. Williams, Twin Lakes, MI (US)

(73) Assignee: Adac Plasitis, Inc, Grand Rapids, MI (US)

( * ) Notice: Subject to any disclaimer, the term of this patent is extended or adjusted under 35 U.S.C. 154(b) by 0 days.

(21) Appl. No.: 09/556,506

(22) Filed: Apr. 24, 2000

(51) Int. Cl.[7] ..... B05D 1/02; B05D 3/02

(52) U.S. Cl. ..... 427/384; 427/195; 427/421; 427/425; 427/477

(58) Field of Search ..... 427/195, 384, 427/385.5, 421, 425, 477, 480, 481, 483, 485, 486; 118/300, 320, 326, 634, 309; 459/50, 55

(56) References Cited

U.S. PATENT DOCUMENTS

| | | | | |
|---|---|---|---|---|
| 2,425,652 | A | | 8/1947 | Starkey |
| 2,565,263 | A | * | 8/1951 | Paasche |
| 2,632,716 | A | | 3/1953 | Starkey |
| 3,296,999 | A | | 1/1967 | Gamble |
| 3,379,377 | A | * | 4/1968 | Ripple |
| 3,513,808 | A | * | 5/1970 | Mortimer et al. |
| 3,517,645 | A | | 6/1970 | Klein, Jr. |
| 4,082,870 | A | | 4/1978 | Yenni |
| 4,239,015 | A | | 12/1980 | Novello et al. |
| 4,448,821 | A | | 5/1984 | Buschor |
| 4,513,682 | A | | 4/1985 | Otocki |
| 4,596,718 | A | | 6/1986 | Gruner |
| 5,209,181 | A | | 5/1993 | Flood |
| 5,427,822 | A | * | 6/1995 | Bracciano |
| 5,518,543 | A | | 5/1996 | Pietrowski et al. |
| 5,681,619 | A | * | 10/1997 | Ogasawara |
| 5,989,644 | A | * | 11/1999 | Williams |

FOREIGN PATENT DOCUMENTS

| | | | |
|---|---|---|---|
| EP | 164899 | * | 12/1985 |
| EP | 192617 | * | 8/1986 |

* cited by examiner

*Primary Examiner*—Fred J. Parker
(74) *Attorney, Agent, or Firm*—Young & Basile, P.C.

(57) ABSTRACT

A method and apparatus for painting parts wherein a plurality of paint coats are applied to a part utilizing a single spray booth for all of the coat applications. The painting apparatus includes a main line track structure extending from a loading station to an unloading station; a closed loop branch track structure having a portion thereof juxtaposed to a portion of the main line track structure between the loading and unloading stations; a paint station located at the juxtaposed portions of the main line and the branch track structure; a plurality of carriers adapted to receive parts to be painted at the paint station and mounted for movement along the main line track structure and the branch track structure; and switch means operative to transfer a carrier between the main line track structure and the branch line track structure. The carriers are moved from the loading station to the paint station along the main line track structure, are passed through the paint station for application of a first coat of paint, and are then recycled through the paint station utilizing the branch track structure a plurality of times to apply a plurality of additional coats to the part whereafter the part, with multiple coats of paint, is switched back to the main line track structure for delivery to the unloading station.

16 Claims, 8 Drawing Sheets

FIG-7
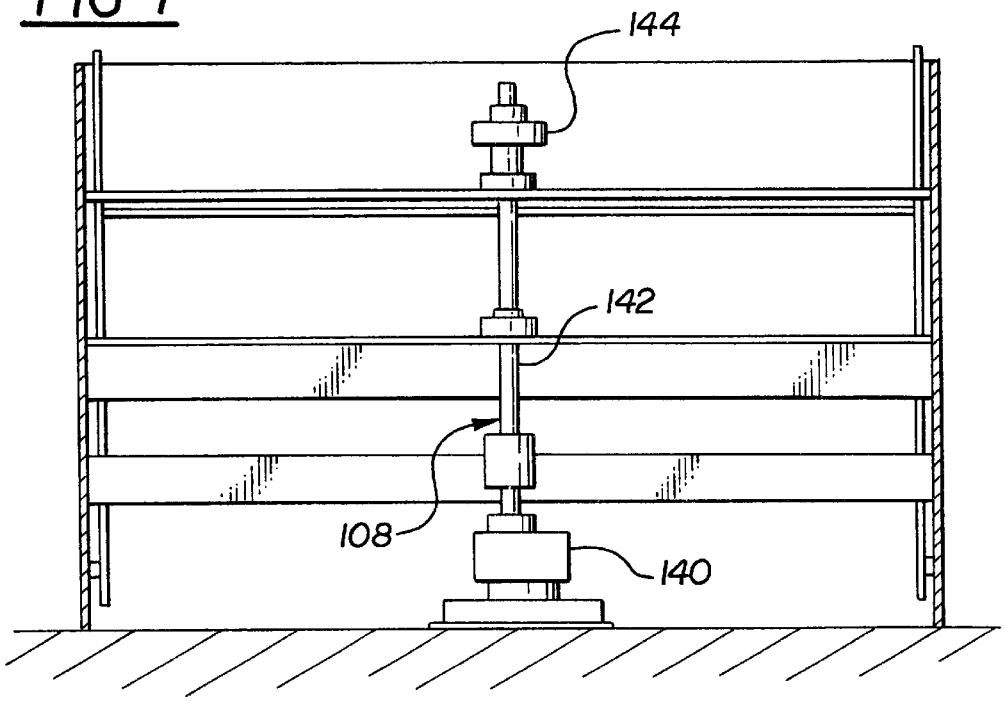
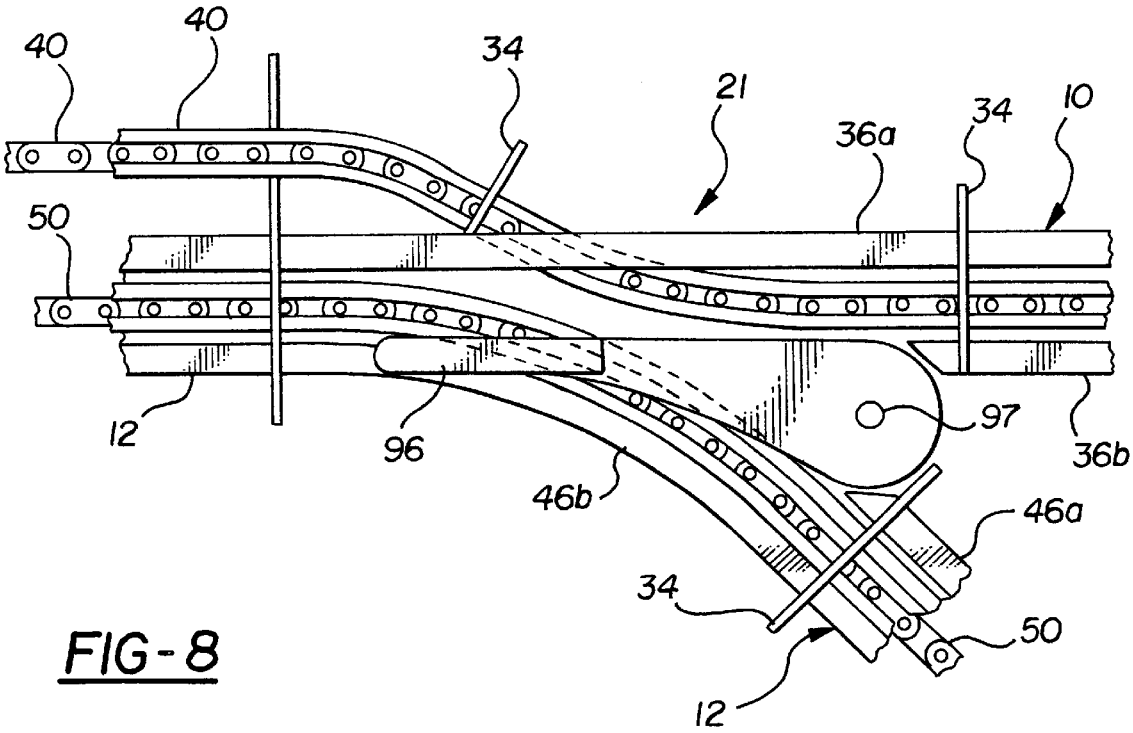
FIG-8

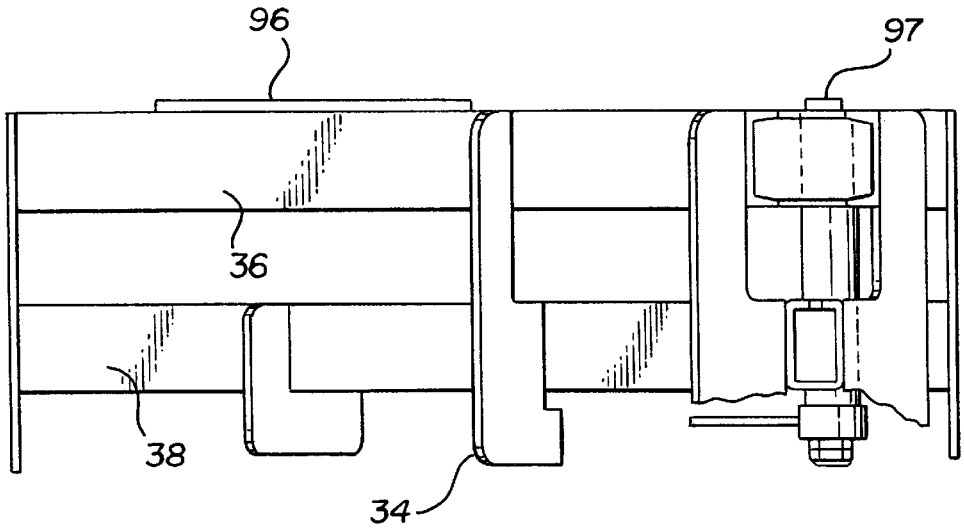
FIG-9
FIG-10
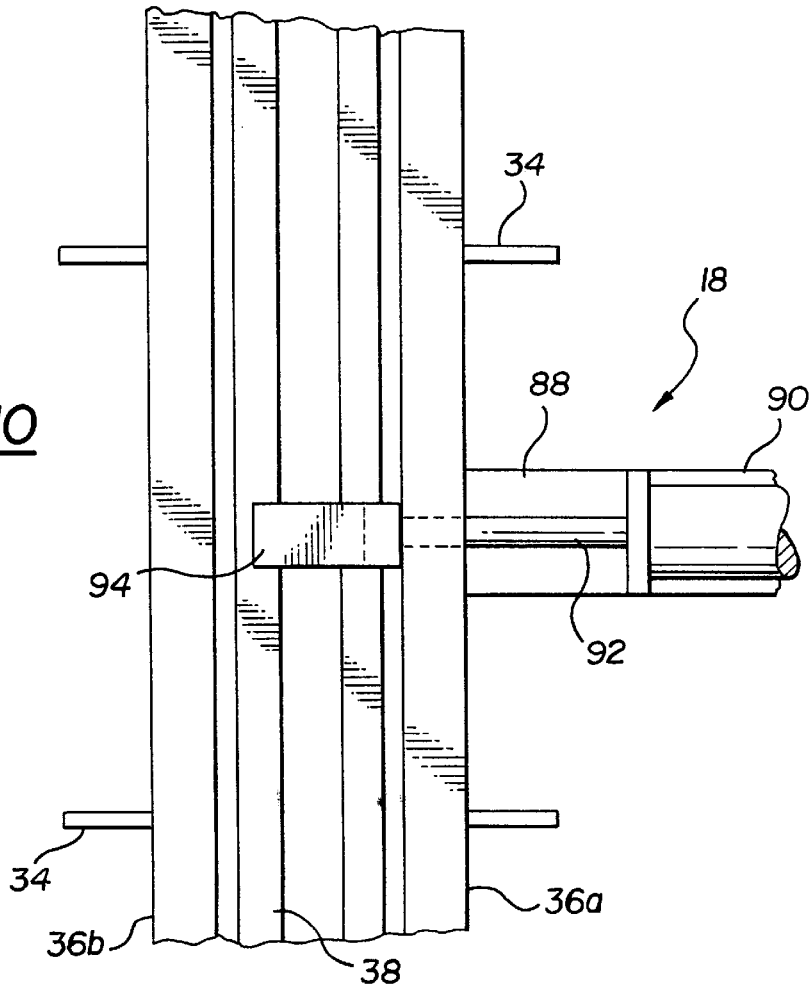

PAINTING APPARATUS AND METHOD

BACKGROUND OF THE INVENTION

This invention relates to apparatus and method for coating parts and more particularly to apparatus and method for spray painting parts.

Most parts in modern industrial equipment require some manner of coating or painting to enhance the appearance of the parts and/or to protect the part. In most modern applications the part requires several coats to optimize the appearance and/or protection. For example, a second base coat may be applied over a first base coat, or one or more clear coats may be applied over one more base coats. Conventional paint technology for the application of several coats has dictated systems that include multiple spray stations or booths for the multiple coats to be applied. The booths are typically located in series and are typically connected by a moving conveyor. Further, when multiple dryer or bake operations are required, it is necessary to use a series of bake ovens between the series of paint booths. These systems, by virtue of their serial technology, require a large amount of factory or floor space. These systems also have a fixed throughput and require the entire system to be activated even if only one section of the system is required.

SUMMARY OF THE INVENTION

This invention is directed to the provision of improved painting apparatus and methodology.

More specifically, this invention is directed to the provision of an improved painting apparatus and methodology whereby a plurality of coats may be applied utilizing a minimum of floor or factory space.

Further, this invention is directed to the provision of an improved painting apparatus and methodology whereby the system throughput is readily variable depending on the number of applications, flash times, and cure times.

The invention paint apparatus and methodology is intended for applying a plurality of smooth even coats to a part utilizing a minimum of floor space.

According to one aspect of the invention methodology, a load station, a spray paint station, a cure station, and a work station are provided in sequence; a part is moved from the load station to the spray paint station; the part is passed a plurality of times through the spray paint station to apply a plurality of coats of paint; the part is moved to the cure station; and the part is thereafter moved to the unload station. This methodology, whereby the part is moved a plurality of times through the same paint station or booth, minimizes the floor space required to apply a given amount of coats to the part.

According to a further feature of the invention methodology, the method includes the further step of providing a wash station between the load station and the spray paint station and the part is moved from the load station to the wash station and thereafter to the spray paint station. This arrangement of a single wash station serving a multiple application spray paint station further reduces the space requirements for the system.

According to a further feature of the invention methodology, each part is stopped in the wash station and rotated while a cleansing liquid is directed against the rotating part. This arrangement provides a 360° part impingement for cleaning and provides a more effective rinse utilizing less water and/or chemicals.

According to a further feature of the invention methodology, the method includes the further step of providing a spin dry station between the wash station and the paint station and each part is stopped at the spin dry station and rotated to spin off excess wash fluid. This arrangement eliminates water spots and reduces dry off oven time and temperature.

According to a further feature of the invention methodology, the paint station includes an entry and exit; a main line path is provided extending from the loading to the paint station entry and from the paint station exit to the unloading station; a recycle path is provided extending from the paint station exit to the paint station entry; a part is moved along the main line path from the loading station to the paint station entry; the part is thereafter moved through the paint station to the paint station exit, whereby to pass the part a first time through the paint station; a first coat of paint is applied to the part as it passes the first time through the paint station; the painted part is moved along the recycle path from the paint station exit to the paint station entry and is thereafter passed through the paint station, from entry to exit, a second time; and a second coat of paint is applied to the part over the first coat as it passes a second time through the paint station. This methodology provides an effective and compact arrangement for applying multiple coats of paint to the part utilizing a single paint station.

According to a further feature of the invention methodology, the recycle path comprises a closed loop path extending through the paint station and the movements of the part through the paint station are on the recycle path. This arrangement simplifies the movement of the part through the paint station.

According to a further feature of the invention methodology, the method further includes providing switch means operative to transfer parts between the main line path and the recycle path. This arrangement allows the parts to be moved through the recycle path a selected, predetermined number of times.

According to a further feature of the invention methodology, the parts moving along the main line path from the loading station to the paint station entry are transferred to the recycle path upon arrival at the paint station entry so that the parts move through the paint station on the recycle path.

According to a further feature of the invention methodology, the parts exiting the paint station on the recycle path are, alternatively, moved around the recycle path for another pass through the paint station or transferred to the main line path for movement to the unloading station.

According to a further feature of the invention methodology, each part arriving at the paint station is stopped at the paint station and rotated while the paint is being applied. This arrangement optimizes the application of the paint to both interior and exterior surfaces of the part.

According to a feature of the painting apparatus of the invention, the apparatus includes a main line track structure extending from a loading station to an unloading station; a closed loop branch track structure having a portion thereof juxtaposed to a portion of the main line track structure between the loading and unloading stations; a paint station located at the juxtaposed portions of the main line and the branch line structure; a plurality of carriers adapted to receive parts to be painted at the paint station, mounted for movement on the main line track structure from the loading station to the unloading station, and further movable along the branch track structure; and switch means operative to transfer a carrier between the main line track structure and the branch line track structure. This apparatus enables carriers carrying parts to be painted to be moved to the paint station and thereafter passed through the paint station a predetermined number of times depending upon the number of coats required.

According to a further feature of the invention apparatus, the paint station includes an entry and an exit and the switch means includes a first switching device proximate the entry to the paint station and a second switching device proximate the exit of the paint station. This switching arrangement enables precise control of the movement of the carriers arriving at and departing from the paint station.

According to a further feature of the invention apparatus, the main line track structure comprises a closed loop track structure. This arrangement allows movement of the carriers and the parts carried thereby in a continuous closed loop around the track structure.

According to a further feature of the invention apparatus, the paint station includes a spray gun assembly including first and second laterally spaced spray guns and stop means operative to halt a carrier at a stop position in the paint station proximate the spray gun assembly, and the spray gun assembly is mounted for selective lateral movement in the paint station to bring respective spray guns into a centered relationship with respect to the stop position and thereby with respect to a carrier stopped at the stop position. This arrangement allows different spray guns to be utilized to apply different coating materials to the part as the part undergoes successive passes through the paint station.

According to a further feature of the invention apparatus, the spray gun assembly is also mounted for vertical reciprocating movement. This arrangement allows the spray gun assembly to provide a uniform distribution of paint over the vertical height of the parts stopped at the spray station.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

FIG. 7 is a view looking in the direction of the arrow 7 in FIG. 6;

FIGS. 8 and 9 are top and side elevational views of a switch device utilized in the invention painting apparatus;

FIG. 10 is a fragmentary plan view of a stop mechanism utilized in the invention painting apparatus;

DESCRIPTION OF THE PREFERRED EMBODIMENT

Figure 1:
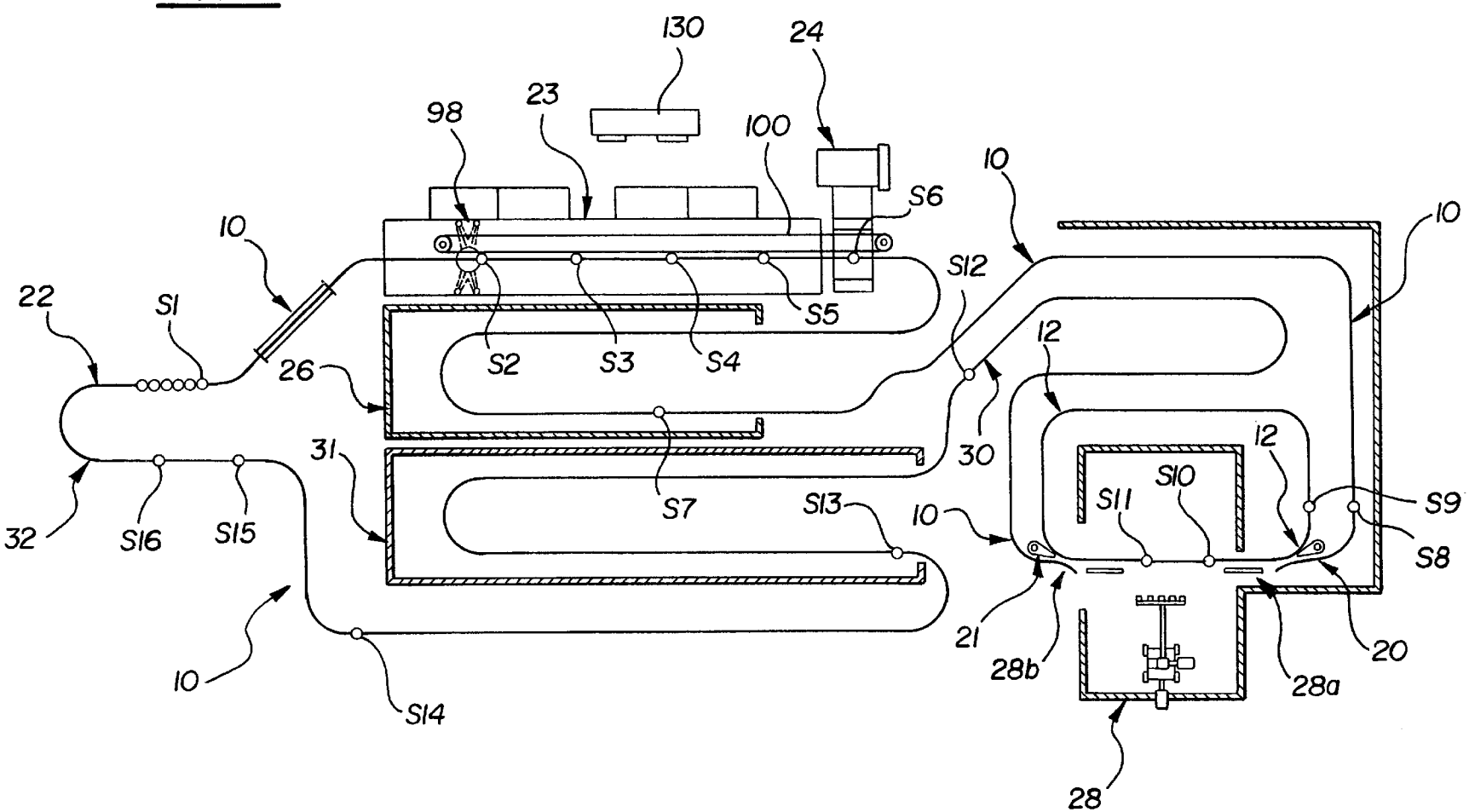
FIG. 1 is a diagrammatic view showing the overall painting apparatus according to the invention.
Figure 2:
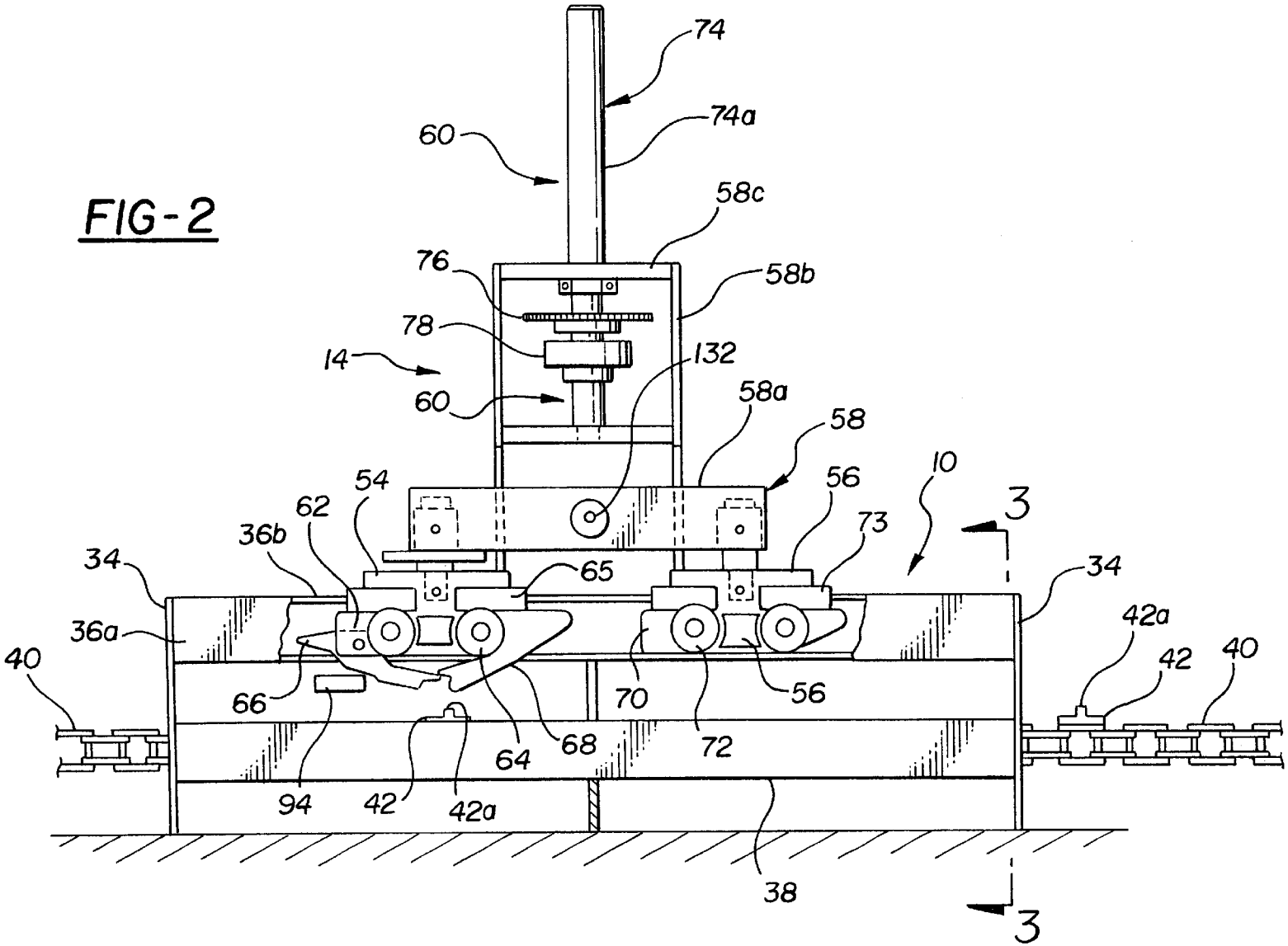
FIG. 2 is a side elevational view of a main line track structure, a trolley, and a carrier utilized in the invention painting apparatus.
Figure 5:
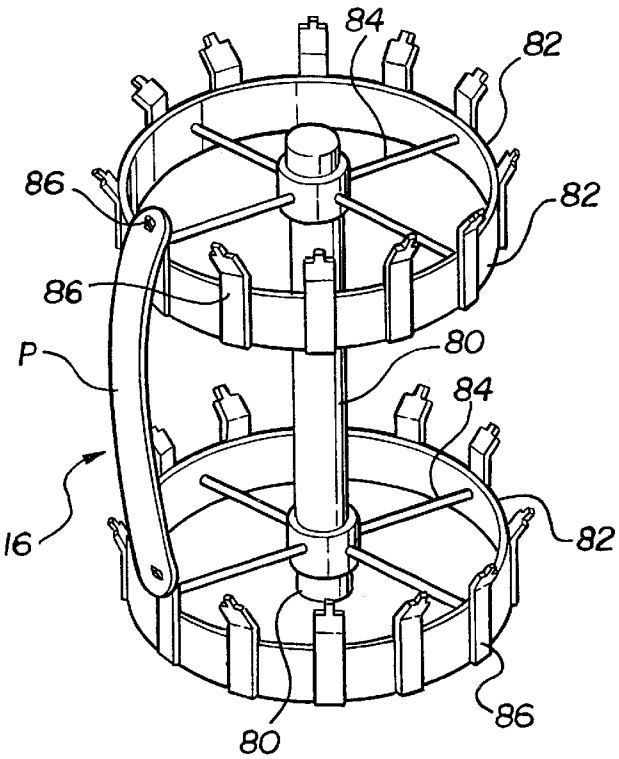
FIG. 5 is a perspective view of a carrier.

The invention painting apparatus, broadly considered, includes a main line track structure 10; a recycle or branch track structure 12; a plurality of trolleys 14; a carrier 16 positioned on each trolley; a plurality of stop devices 18; switch devices 20 and 21; a loading station 22; a wash station 23; a spin dry station 24; a dry off oven station 26; a paint station or booth 28; a flash station 30; a cure oven station 31; and an unload station 32.

Main line track structure 10 (FIGS. 1, 2, 3, and 12) defines a closed loop path extending from the load station 22 to the wash station 23 to the spin dry station 24 to the dry off oven 26 to the paint booth 28 to the flash station 30 to the cure oven 31 to the unload station 32 and then back to the load station 22 to complete the closed continuous loop. Main line track structure 10 is a power and free structure including a plurality of spaced support brackets 34; an upper conveyor track 36*a*, 36*b* positioned in an upper cutout 34*a* of the support brackets; a lower track 38 positioned in a lower cutout 34*b* of the support brackets beneath the track 36, and a continuous chain link conveyor 40 positioned in track 38 and including spaced dog plates 42 fixedly secured to an upper face of the conveyor and each including an upstanding finger 42*a*. Conveyor 40 is continuously driven by a schematically shown powered sprocket 44.

Figure 4:
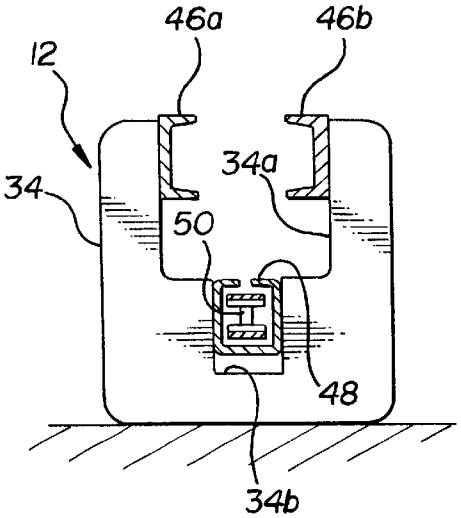
FIG. 4 is a view similar to FIG. 3 but showing a recycle track structure.
Figure 3:
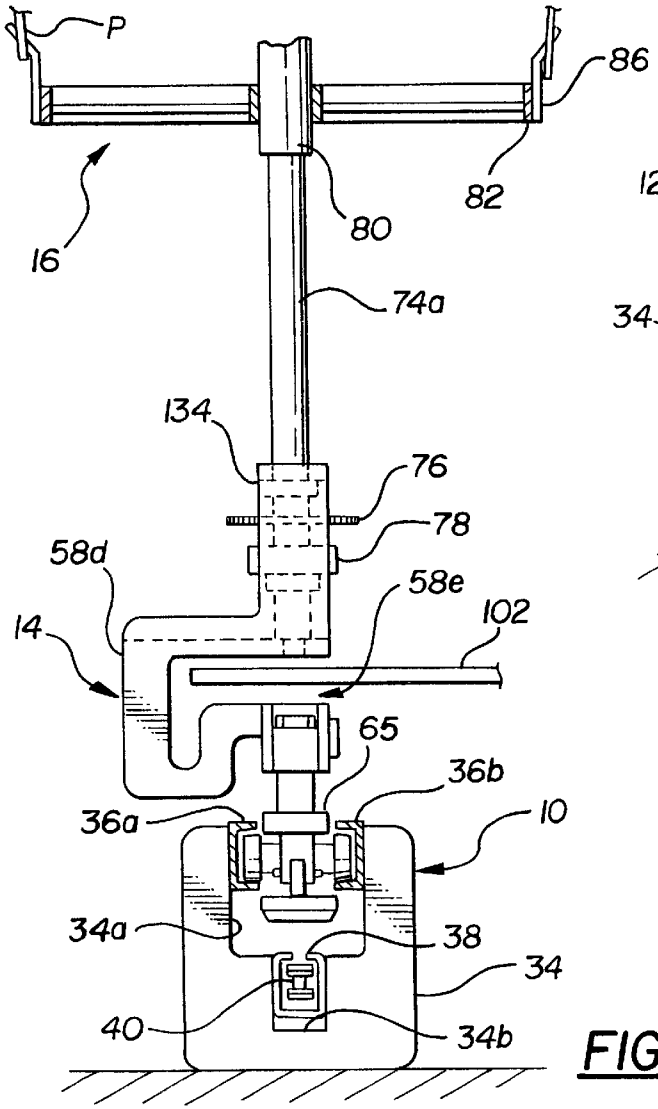
FIG. 3 is a cross-sectional view taken on line 3—3 of FIG. 2.

Recycle or branch track structure 12 (FIGS. 1, 4, and 12) has a closed loop configuration and is positioned within the closed loop defined by main line track structure 10. Recycle track structure 12 extends through paint booth 28 in juxtaposed parallel relation to the adjacent portion of main line track structure 10 and has a construction generally corresponding to the construction of main line track structure 10. Specifically, recycle track structure 12 includes a plurality of spaced support brackets 34; an upper track 46*a* and 46*b* supported within an upper cutout 34*a* of the brackets; a lower track 48 supported in a lower cutout 34*b* of the brackets, and a chain link conveyor 50 positioned within track 48, including spaced dog plates 42 and driven continuously by schematically shown powered sprocket 52.

Each trolley 14 (FIGS. 2, 3, and 6) includes a leading truck 54; a trailing truck 56; a frame structure 58; and a spindle assembly 60. Leading truck 54 includes a body 62; support wheels 64 rollably guiding in upper tracks 36 or 46; guide rollers 65 positioned between upper tracks 36*a*, 36*b* or 46*a*, 46*b*; a dog 66 pivotally mounted proximate the forward end of the body; and a catch 68 for latching coaction with the dog 66.

Trailing truck 56 includes a body 70, support wheels 72 rollably guiding in upper tracks 36 or 46, and guide rollers 73 positioned rollably between upper tracks 36*a*, 36*b* or 46*a*, 46*b*.

Frame structure 58 includes a main body portion 58*a* pivotally connected at its forward and rearward ends respectively to the leading and trailing trucks and a tower structure 58*b*. The pivotal connection of the main body frame structure 58*a* to the leading and trailing trucks will be understood to allow the trolley to negotiate curves in the track structures.

Spindle assembly 60 includes a spindle 74 mounted for rotation in tower structure 58*b* and including a portion 74*a* upstanding from the tower structure; a sprocket 76 fixedly secured to the spindle beneath the upper plate 58*c* of the tower structure; and a drive wheel 78 fixedly secured to the spindle beneath sprocket 76.

Each carrier 16 includes a central hollow post 80 adapted to be positioned over the upper portion 74*a* of spindle 74 and fixedly secured thereto; upper and lower hoops 82 positioned concentrically on the post and connected to the post by spokes 84 emanating from the post; and a plurality of circumferentially spaced clips 86 carried by each hoop.

Each stop device 18 (FIGS. 2 and 10) includes a bracket 88 fixedly positioned proximate the main line track structure or the recycle track structure; a power cylinder 90 carried by bracket 88; a piston rod 92 powered by the cylinder; and a stop plate 94 carried on the free end of the piston rod and movable by the stop cylinder between an operative position directly underlying tracks 36 or 46 and a retracted position in which the stop plate is withdrawn from the area beneath the tracks. Stop devices 18 are positioned at spaced locations along the main line track structure and the recycle track structure and, specifically, are positioned at stop locations S1 proximate the loading station 22; S2, S3, S4, and S5 within the wash station 23; S6 at the spin dry station 24; S7 within the dry off oven station 26; S8 along the main line track structure immediately preceding the entry 28*a* to the paint booth 28; S9 on the recycle track structure immediately preceding the entry 28*a* to the paint booth 28; S10 and S11 within the paint booth; S12 at the flash station 30; S13 within the cure oven 31; and S15 and S16 at the unload station 32.

Switch device 21 (FIGS. 8 and 9) includes a switch element 96 mounted for pivotal movement about a pivot axis 97 between first and second positions in which trolleys moving along the recycle track structure within the paint spray booth may be selectively routed either along the main line track structure to the unload station or along the recycle track structure for a further pass through the paint booth. Switch device 20 is a mirror image of switch device 21 and includes a switching element 96 mounted for pivotal movement about pivot axis 97 and operative to selectively direct trolleys arriving on the main line track structure at the entry 28*a* into the paint booth along the recycle track structure or direct trolleys arriving on the recycle track structure at the paint booth entry 28*a* into the paint booth along the recycle track structure.

The upper track structure 36*a*, 36*b* of the main line track structure is omitted between switches 20 and 21 so that trolleys arriving at entry switch 20, irrespective of whether they are arriving on the main line track structure or the recycle track structure, are routed through the paint spray booth on the upper track structure of the recycle track structure, and trolleys arriving at the exit switch 21 on the upper track structure of the recycle track structure are routed by the switch element either along the upper track structure of the recycle track structure for a repeat cycle through the paint spray booth or along the upper track structure of the main line track structure for movement to the unload station.

Loading station 22 (FIG. 1) comprises an area at which an operator may load parts P (such as a trunk finisher element) onto a carrier 16 positioned at the load area with the upper and lower ends of each part P fixedly secured to the clips 86 of the upper and lower hoops 82 of the carrier.

Wash station 23 comprises an enclosed area within which stop locations S2, S3, S4, and S5 are positioned and within which washer spray assemblies 98 are positioned proximate each stop location. Each washer spray assembly includes a plurality of circumferentially spaced washers 96*a* each directed radially inwardly at the main line track structure proximate the respective stop location. A closed loop drive chain 100 is positioned within the wash station, extends parallel to the main line track structure, and coacts with the sprocket 76 of a carrier stopped at each stop location within the washer to spin each carrier and thereby move the parts carried by the carrier in a 360° path within the circumferentially spaced nozzles of the respective washer assembly 98 to ensure thorough washing of the parts.

The frame structure 58 of each trolley 14 includes an offset C-shaped structure 58*d* (FIG. 3) to define a slot 58*e* into which a shield plate 102 positioned within the wash station may pass as the trolleys move through the wash station so as to shield the underlying trolley structures from the impact and the moisture of the washing operation.

Spin dry station 24 is positioned immediately following the wash station and includes a booth where the carriers may be halted while the carriers and the parts carried thereby are spun by the chain 100 engaging the sprocket 76 whereby to spin off or blow off excess moisture on the parts.

Dry off oven station 26 comprises a closed housing through which a U-shaped portion of the main line track structure 10 passes and in which suitable heating elements are positioned to dry off the parts on the carriers prior to their delivery to the paint station.

Paint station 28 (FIGS. 1, 6, and 12) is in the form of a booth which encloses stop device locations S10 and S11 and further encloses the juxtaposed portions of the main line track structure 10 and the recycle track structure 12. Paint station 28 includes a spray gun assembly 104, a clamp assembly 106, and a spin assembly 108. For purposes of clarity, clamp assembly 106 and spin assembly 108 are omitted in FIG. 12.

Spray gun assembly 104 includes a carriage 110 movable along a track structure 112 by a power cylinder 114; a post 116 movable laterally with respect to the carriage 112 by a power cylinder 118; and a spray gun array 120 mounted on a rod 122 and movable in a vertical or reciprocal fashion on post 116 by a power cylinder 124 mounted on post 116. Spray gun array 120 includes two left spray guns 126 and 128 and two right spray guns 130 and 132.

Figure 6:
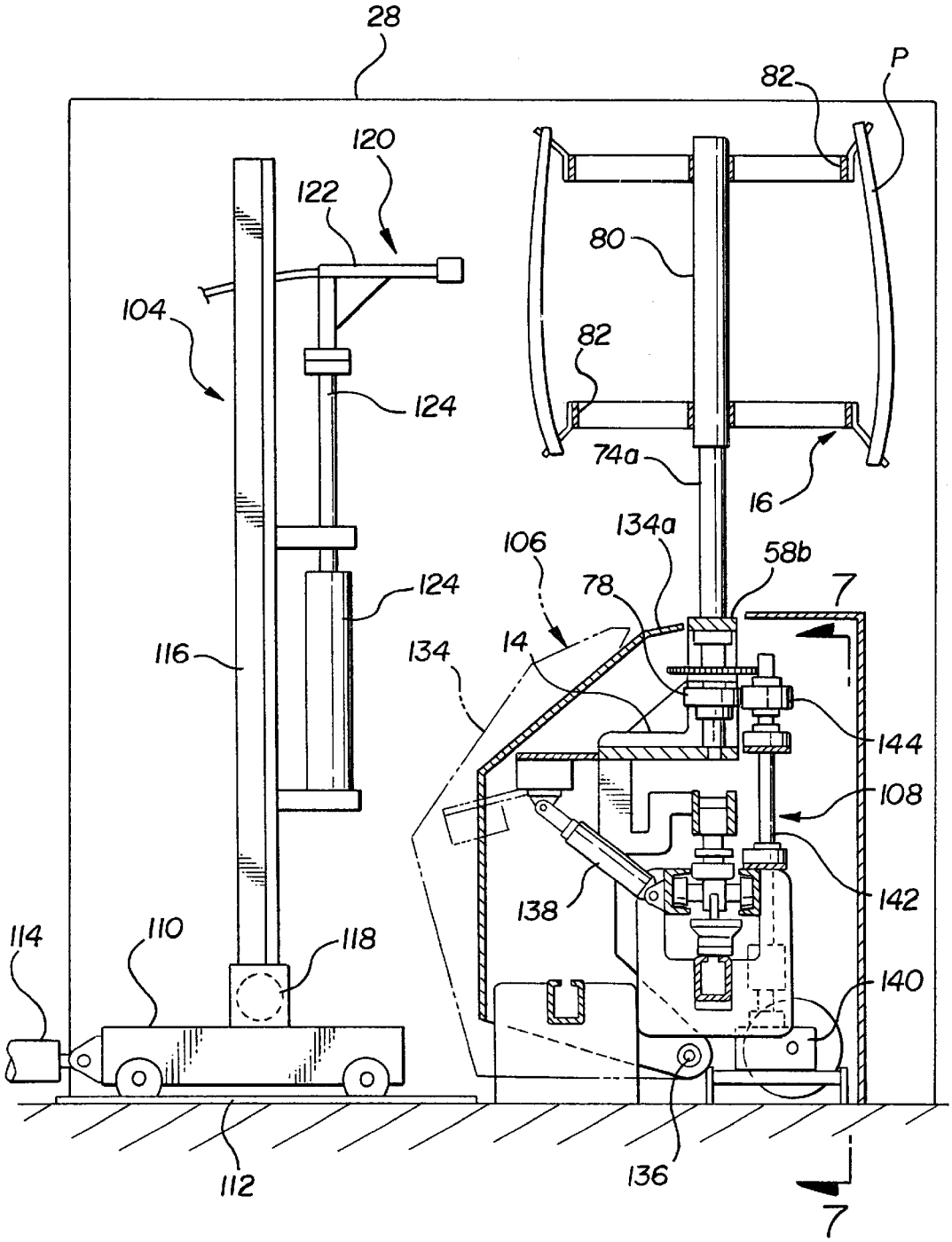
FIG. 6 is a view of a trolley and carrier positioned at the paint station.
Figure 11:
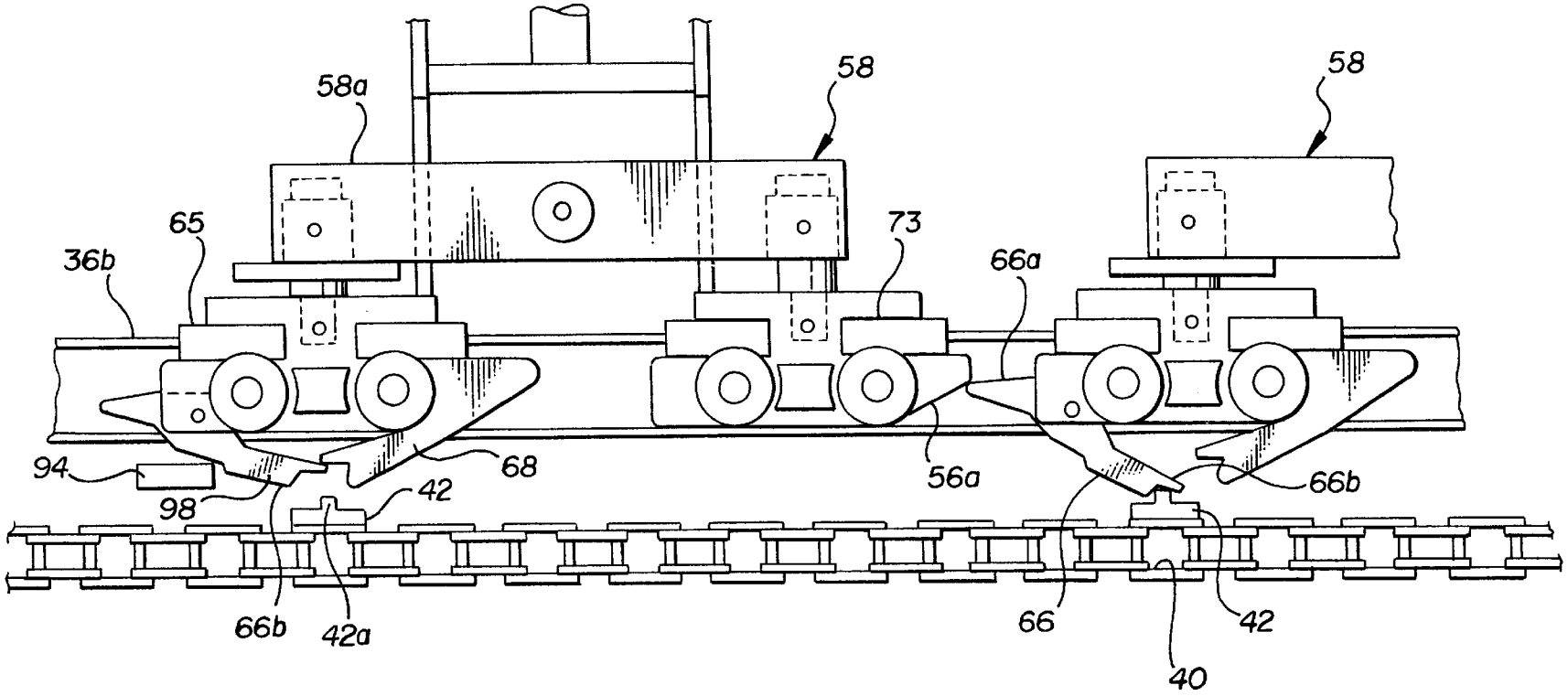
FIG. 11 is a fragmentary view showing details of a conveyor structure.
Figure 12:
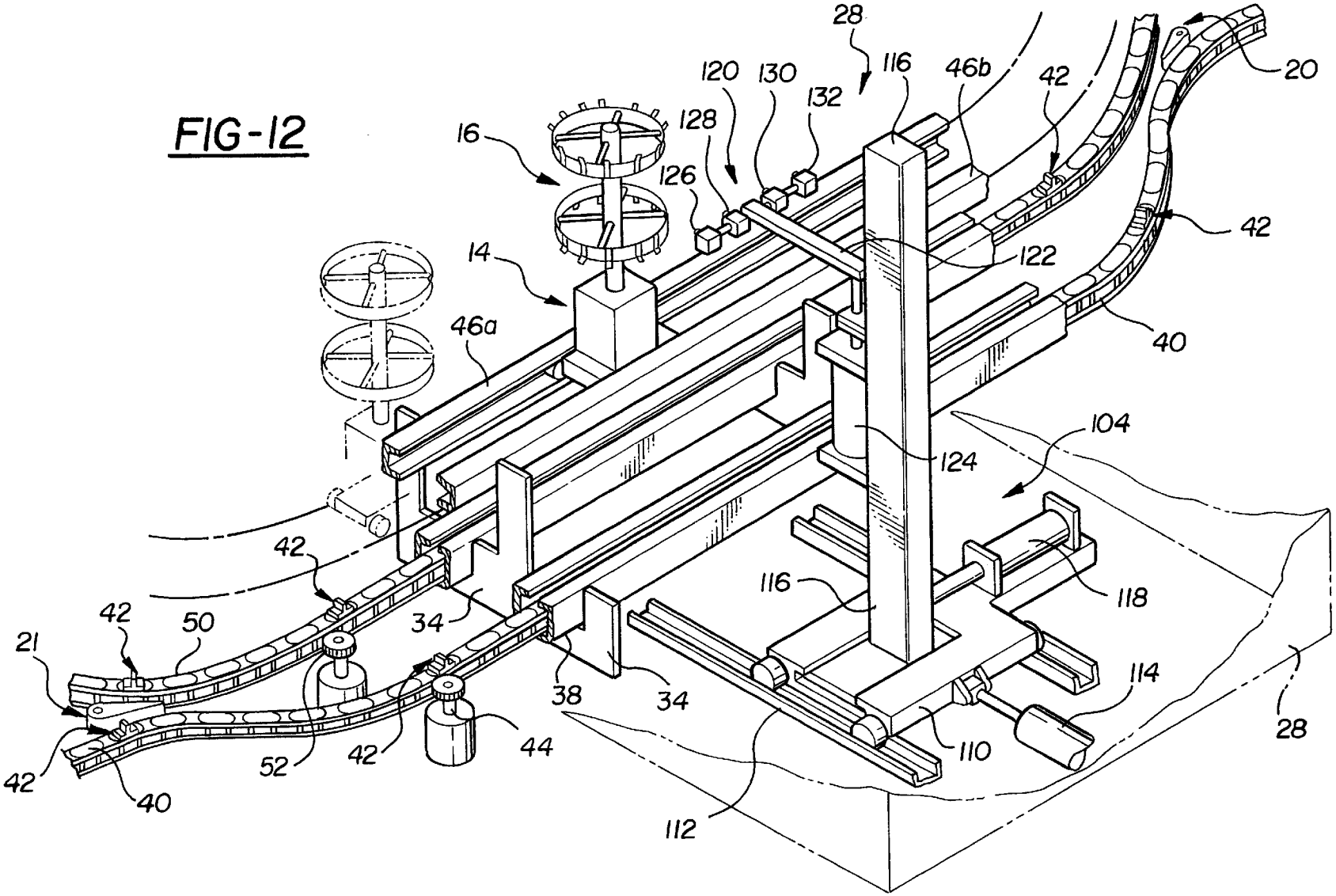
FIG. 12 is a fragmentary perspective view showing details of a painting station.

Clamp assembly 106 includes a clamp member 134 positioned proximate stop device location S11 and movable about a pivot axis 136 by a stop cylinder 138 between a retracted position seen in dash lines in FIG. 6 and a solid line position in which the upper free end 134*a* of the clamp member engages the tower structure 58*b* of a trolley positioned at the stop location and urges the trolley in a rightward direction as seen in FIG. 6.

Spin assembly 108 is positioned proximate the stop location S11 in opposition to the clamp assembly 106 and includes a reversible electric motor 140 driving a vertical shaft 142 and a drive wheel 144 positioned on the upper free end of the drive shaft 142 for engagement with the drive wheel 78 of a trolley positioned at the stop location whereby to impart a spinning movement to the carrier carried by the trolley and thereby to the parts carried by the carrier. The direction of the spinning movement imparted to the carrier may be reversed by reverse actuation of motor 140.

Flash station 30 is positioned along the main line track structure 10 proximate the stop station S12 and represents an area at which the trolleys are halted following the painting operation for a fixed period of time to allow solvent to escape from the paint that has been applied to the parts at the paint station.

Cure oven station 31 comprises a closed housing through which a U-shaped portion of the main line track structure extends, within which stop location S13 is located, and within which suitable heating elements are positioned to cure the paint that has been applied to the parts at the paint station.

Unload station 32 comprises a straight portion of main line track structure 10, immediately opposite load station 22, at which the trolleys are halted to allow an operator to unload the parts from their carriers whereafter the trolleys and carriers may move to the load station for receipt of new parts to be painted.

OPERATION

Trolleys 14 arriving at the stop station S1 at the load station 22 are stopped at the station S1 by actuation of the stop device 18 positioned at the location S1 and specifically by the engagement of the stop plate 94 of the stop device with the dog 66 of the trolley to lift the lower notched portion 66*b* of the dog out of engagement with the finger 42*a* of the stop plate 42 carried by the chain 40. The trolleys are preferably moved through the painting apparatus in batches such, for example, as batches of six as seen diagrammatically at location S1 in the load station 22.

The first trolley of the batch arriving at the stop location S1 is halted at the station by the engagement of the stop plate 94 of the stop device with the dog of the first trolley and subsequent trolleys arriving at the station are disengaged from the track 40 as the tip 66*a* of the dog of the arriving trolley engages the angled rear cam surface 56*a* of the trailing truck of the trolley already stopped at the location S1 whereby to pivot the dog 66 about its pivot axis and disengage the lower notched portion 66*b* of the dog from the finger 42*a* of the dog plate 42. Each successive trolley arriving at the stop location S1 is halted behind the preceding trolley in the same manner until all of the trolleys of the batch (for example, six trolleys) have stacked up at the stop S1. Parts P are now loaded by the operator onto the carriers of the trolleys positioned at the location S1 whereafter the stop device 18 at the location S1 is actuated to withdraw the stop plate 94, allow the dog 66 of the leading trolley to pivot into engagement with the lug 42*a* of a dog plate 42, and allow the trolley to continue along the track and into the wash station 26 where the trolley is stopped at the location S2 by the stop device 18 positioned at that location.

As the leading trolley leaves the stop location S1 at the load station the dog 66 of the next trolley pivots downwardly into engagement with the drive chain so that the next trolley follows the leading trolley to the washer station where it parks itself behind the leading trolley. The succeeding trolleys in the batch follow behind and successively park themselves behind the leading trolleys so that the entire batch is now staged in the wash station at the stop location S2. At this time the endless chain 100 is actuated to drive the sprockets 76 of the carriers lined up at the stop location and at the same time the wash nozzles of the washer assemblies 98 are actuated so that pressurized washing fluid (at a temperature of, for example, 180° F.) is projected onto the parts P as they are spinning at the station S2.

Following a predetermined time at the station S2, the stop device 18 at that location is retracted to allow the trolleys to proceed in sequential order to stop location S3 where they are stopped by the stop device positioned at that station. At the same time the next batch of six trolleys accumulates at the stop location S2 and all of the carriers position on all of the trolleys located at the stations S2 and S3 are simultaneously driven by the chain 100 while the washers are actuated to project heated washer fluid under pressure onto the spinning parts at locations S2 and S3. This procedure is now repeated until a batch of parts is located at each of the stop locations S2, S3, S4, and S5 so that each part passing through the washer station is stopped within the washer station a total four times and each time is subjected to heated, pressurized fluid as it is spun by the chain 100.

The trolleys leaving stop location S5 in the washer station next proceed to the spin station 24 where the stop device 18 located at stop location S6 is actuated to successively halt the batch of trolleys within the spin dry station whereupon the endless chain 100 again acts to spin the carriers via the sprockets 76 and subject the parts carried by the carriers to a spinning operation which has the effect of throwing off excess moisture from the parts.

The parts thereafter proceed sequentially along the main line track structure into the dry off oven until they arrive at the stop location S7 where the stop device positioned at that location is actuated to stop the batch of trolleys within the oven. The trolleys may remain within the oven, for example, for twenty minutes at 180° F. to dry the parts whereafter the parts are released by retraction of the stop plate of the stop device and proceed along the main line track structure to the stop location S8 where the parts again are stacked up as a batch.

The parts may remain at this location, for example, for ten minutes during which time the parts are allowed to cool whereafter the stop device 18 at the stop location S8 is withdrawn to allow the trolleys to proceed, one at a time, to the paint spray booth. The switching element 96 of the switch 20 is positioned at this time in a location to allow a trolley moving from the stop location S8 along the main line track structure to switch onto the recycle track structure proximate the entry 28*a* of the booth whereafter the first trolley may move into the paint booth along the recycle track structure to the stop location S11 proximate the spray gun assembly 104. The second carrier of the batch is now released for movement to the stop location S10 within the paint spray booth. Note that the carriers are released from location S8 by sequential action of the stop device 18 positioned at that station so that the carriers move to the paint booth separately and individually rather than as a batch.

As the first trolley arrives at the stop location S11, clamp assembly 106 is actuated in a sense to urge the drive wheel 78 of the spindle assembly into engagement with the drive wheel 144 of spin assembly 108 and the spin assembly is actuated to rotate the carrier and thereby the parts carried thereby. As the parts are rotated at the location S11 the spray gun array is moved laterally by the power cylinder 118 to a location in which the left spray guns 126 and 128 are directly opposite the parts stopped at the location S11 whereafter, for example, a base color paint may be supplied under pressure to the guns 126 and 128 for application onto the spinning parts at the location S11 while the cylinder 124 is actuated to reciprocate the spray guns vertically and ensure complete coverage of the parts. Typically one up and down movement of the spray guns is sufficient to provide adequate coverage to both the exterior and the interior surfaces of the spinning parts on the spinning carriers.

For parts presenting a variable profile in a vertical direction, cylinder 114 may be selectively actuated to move carriage 110 forwardly and rearwardly on track structure 112 to move the spray gun array toward and away from the spinning parts as the spray gun array is moved in a vertical or reciprocal fashion on post 116 by power cylinder 124. For example, the in and out movement of the carriage may be programmed relative to the up and down movement of the spray gun assembly such that the distance between the spray guns and the parts being painted remains substantially constant during the up and down movement of the spray gun assembly irrespective of significant variations in the profile of the parts as measured in a vertical direction.

Following the application of the first coat of base or color, the first trolley is released from location S11 for movement along the recycle track structure to the stop location S9 and the second trolley of the batch positioned at location S10 within the paint spray booth is released for movement to the location S11 where it is painted with a base color coat in the manner previously described with respect to the first trolley and is thereafter released for movement to the stop location S9 where it queues up behind the first trolley already positioned at that station. This procedure is repeated until all six of the trolleys staged at the location S8 have been processed through the paint booth and have been given a first coat of base color paint. The switching element 96 of switch 21 is positioned during this procedure so as to direct trolleys leaving the paint spray booth along the recycle track structure.

After all six of the trolleys in the batch have been staged at location S9, the trolleys are released, one at a time, for movement to location S10, and thereafter to location S11 for painting, the trolleys now benefitting from movement of the switching element 96 to a position allowing the trolleys to move along the recycle track structure and into the paint spray booth. Each trolley arriving at location S10 is held only momentarily at that location and, specifically, only long enough for the painting of the parts on the trolley positioned at location S11 to be completed. As each trolley is successively stopped at the location S11 it may be given, for example, a second coat of base color utilizing the left guns 126 and 128 whereafter the trolley is released in the manner previously described for a further recycling movement around the recycle track structure for further staging at the stop location S9. After all six of the trolleys have again been staged at the stop location S9, they are individually released for recycling movement to location S10 and then to the paint stop location S11. Each part arriving on a carrier at the location S11, which has now already received two base color coats, may now receive a first clear coat. This is accomplished by utilizing the power cylinder 118 to move the spray gun array 120 to the left as seen in FIG. 1 to move the guns 130 and 132 into direct opposition to the stop location S11 whereafter clear coat paint may be supplied to the guns 130 and 132 for application to the spinning parts with the spray gun assembly again being moved reciprocally through a complete up and down cycle to ensure complete coverage with the clear coat paint. Following this application of this first coat of clear coat paint, each trolley is again released for movement to stop location S9 where the trolleys again queue up as each trolley moves through the paint booth, stops at the location S11 to receive a clear coat, and moves around the recycle track structure to queue up at the stop location S9. The trolleys are now individually released from the station S9 and moved to station S11 where the guns 130 and 132 are again utilized to apply a second coat of clear coat to the spinning parts.

Each time that a carrier is positioned at the paint station, the carrier may be spun first in one direction and then, by reversal of motor 140, spun in the opposite direction. This reverse spin procedure may be used, for example, when the parts being painted have a "handed" configuration such that total coverage cannot be assured unless and until the parts, while being painted, have been spun in both a clockwise and a counterclockwise direction.

After the parts have received a second coat of clear coat, the respective trolley is released and the switch element 96 is moved to a position to allow the trolley to be transferred from the recycle track structure to the main line track structure for movement along the main line track structure to the flash station 30 where the stop device at the location S12 is actuated to stop the trolley at that location whereafter the next five trolleys, having received the second clear coat in the paint booth, are successively diverted onto the main line track structure as they leave the paint booth for movement to the flash station where they queue up behind the first trolley.

The batch of trolleys may remain in the flash station, for example, for ten minutes to allow the solvent to escape from the paint that has been applied to the parts in the paint booth, whereafter the trolleys may be released by withdrawal of the stop plate of the stop device and allowed to move as a batch into the cure oven where they are stopped at the stop location S13 and allowed to remain in the cure oven, for example, for forty-three minutes at 180° F. to cure the paint. Following the curing of the paint, the trolleys are released by suitable actuation of the stop plate of the stop device at the stop location S13 for movement to the stop location S14 where the trolleys are again allowed to queue up in a waiting operation whereafter the trolleys are released for movement as a batch to the unload location S15 and thereafter to the unload location S16. It will be understood that the parts are unloaded from the carriers at the unload locations S15 and S16 whereafter the carriers are released for movement to the stop location S1 at the load station and the cycle may again begin.

As will be apparent, the number of trolleys that are batched for movement through the painting apparatus can be varied depending on various parameters and the number and mix of base coats and clear coats may be readily varied depending on various parameters.

As will also be apparent, a control panel 130 (FIG. 1) will be provided to control the required operations at the various stations. The control system monitored by the control panel may include, for example, a sensor 132 located on each trolley for coaction with sensors located along the track structure so that the location in the system of each trolley is known at all times.

The painting apparatus and methodology of the invention will be seen to significantly reduce the amount of "footprint" or floor space required to provide a given number of coats on a particular part. The reduced floor space requirements result from the arrangement whereby a single paint booth is utilized to apply a plurality of coats of paint to the part and by the further fact that only a single cure oven is required to perform the curing function irrespective of the number of coats of paint that are applied to the part. The required floor space is further reduced by the arrangement whereby the parts are stopped and rotated at a plurality of locations in the wash station rather than proceeding through the wash station on a continuous basis. The invention apparatus and methodology also eliminates the need, as in the prior art series arrangements, to activate the entire paint system even when only portions of the system are required to perform a desired painting operation. By contrast, in the invention system, the number of recycling operations is simply varied in accordance with the desired painting operation so that at no time are sections of the system being operated in a non-productive fashion.

Whereas a preferred embodiment of the invention has been illustrated and described in detail, it will be apparent that various changes may be made in a disclosed embodiment without departing from the scope or spirit of the invention.

What is claimed is:

1. A method of spray painting components comprising;

providing, in sequence, a load station, a paint spray station, a cure station and an unload station;

moving a part to be painted from the load station to a stop location at the spray station;

applying a first coat of paint to the part at the spray station stop location;

thereafter, prior to moving the part to the cure station, removing the part from the spray station stop location, returning the part to the spray station stop location, and applying a second coat of paint to the part at the spray station stop location;

moving the part to the cure station; and thereafter moving the part to the unload station.

2. A method according to claim 1 wherein, during each application of paint at the spray station stop location, the part is stopped and rotated while the paint is being applied.

3. A method according to claim 1 wherein:

the method includes the further step of providing a wash station between the load station and the paint spray station; and the part is moved from the load station to the wash station and thereafter to the paint spray station.

4. A method according to claim 3 wherein:

each part is stopped in the wash station and rotated while a cleansing fluid is directed against the rotating part.

5. A method according to claim 4 wherein:

the method includes the further step of providing a spin dry station between the wash station and the paint station; and each part is stopped at the spin dry station and rotated to spin off excess wash fluid.

6. A method of painting parts comprising:

providing a paint station having an entry and an exit;

providing a main line path extending from a loading station to the paint station entry, and from the paint station exit to an unloading station;

providing a recycle path extending from the paint station exit to the paint station entry;

moving a part along the main line path from the loading station to the paint station entry;

thereafter moving the part through the paint station to the paint station exit, whereby to pass the part a first time through the paint station;

applying a first coat of paint to the part as it passes the first time through the paint station;

moving the painted part along the recycle path from the paint station exit to the paint station entry and thereafter passing the part through the paint station, from entry to exit, a second time; and applying a second coat of paint to the part over the first coat as it passes the second time through the paint station.

7. A method according to claim 6 wherein:

the recycle path comprises a closed loop path extending through the paint station; and the movements of the part through the paint station are on the recycle path.

8. A method according to claim 6 wherein the method further includes providing switch means operative to transfer parts between the main line path and the recycle path.

9. A method according to claim 7 wherein:

the method further includes providing switch means operative to transfer parts between the main line path and the recycle line path; and parts moving along the main line path from the loading station to the paint station entry are transferred to the recycle path upon arrival at the paint station entry so that the parts move through the paint station on the recycle path.

10. A method according to claim 9 wherein parts exiting the paint station on the recycle path are, alternatively, moved around the recycle path for another pass through the paint station or transferred to the main line path for movement to the unloading station.

11. A method according to claim 6 wherein each part arriving at the paint station is stopped at the paint station and rotated while the paint is being applied.

12. A method according to claim 11 wherein each part arriving at the paint station is rotated in a first direction while paint is applied and thereafter rotated in a second direction while further paint is applied.

13. A method according to claim 11 wherein:

a spray gun assembly is provided at the paint station; and the spray gun assembly is moved up and down as paint is applied to the rotating part.

14. A method according to claim 11 wherein:

a spray gun assembly is provided at the paint station; and the spray gun assembly is moved toward and away from the paint station as paint is applied to the rotating part.

15. A method according to claim 13 wherein the spray gun assembly is moved up and down and simultaneously moved toward and away from the paint station as paint is applied to the rotating part.

16. A method of spray painting parts comprising;

providing, in sequence, a load station, a paint spray station, a cure station and an unload station;

moving a part to be painted from the load station to the paint spray station;

passing the part a plurality of times through the paint spray station to apply a plurality of coats of paint;

moving the part to the cure station;

moving the part to the unload station; and between each successive pass of a part through the paint spray station, moving the part along a recycle path extending from an exit of the paint spray station to an entry to the paint spray station.

* * * * *